US009298132B2

(12) United States Patent
Suzuki

(10) Patent No.: US 9,298,132 B2
(45) Date of Patent: Mar. 29, 2016

(54) DEVELOPER SUPPLYING APPARATUS

(71) Applicant: CANON KABUSHIKI KAISHA, Tokyo (JP)

(72) Inventor: Hideaki Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/465,859

(22) Filed: Aug. 22, 2014

(65) Prior Publication Data

US 2015/0055985 A1 Feb. 26, 2015

(30) Foreign Application Priority Data

Aug. 26, 2013 (JP) ..... 2013-174056

(51) Int. Cl.
*G03G 15/08* (2006.01)

(52) U.S. Cl.
CPC ..... *G03G 15/0879* (2013.01)

(58) Field of Classification Search
CPC ..... G03G 15/0877; G03G 15/0865; G03G 15/0872; G03G 15/0867; G03G 2215/0685; G03G 15/0855; G03G 15/0856; G03G 15/0868; G03G 15/0875; G03G 15/0879; G03G 15/0886; G03G 15/0894; G03G 15/0832

See application file for complete search history.

(56) References Cited

U.S. PATENT DOCUMENTS

| | | | | |
|---|---|---|---|---|
| 6,292,640 | B1 | 9/2001 | Suzuki | |
| 6,330,411 | B1 | 12/2001 | Suzuki | |
| 8,385,754 | B2 | 2/2013 | Hirobe et al. | |
| 2009/0028611 | A1 * | 1/2009 | Matsumoto et al. | 399/258 |
| 2012/0070165 | A1 | 3/2012 | Suzuki | |

FOREIGN PATENT DOCUMENTS

| | | | |
|---|---|---|---|
| JP | 09-204093 | A | 8/1997 |
| JP | 2009-169392 | A | 7/2009 |
| JP | 2012-042533 | A | 3/2012 |

* cited by examiner

*Primary Examiner* — Roy Y Yi
(74) *Attorney, Agent, or Firm* — Fitzpatrick, Cella, Harper & Scinto

(57) ABSTRACT

A supplying apparatus includes a supply container including an accommodating portion configured to accommodate a developer, a discharge opening configured to discharge the developer out of the accommodating portion, and an expansion-and-contraction portion having a variable inside volume. The developer is supplied from the supply container through the discharge opening using an inside pressure variation of the supply container caused by expansion and contraction of the expansion-and-contraction portion. In addition, a receiving portion receives the developer supplied from the supply container and forms a feeding path along which the developer is fed, and a decomposing member is non-rotatably fixed at a position opposing, in a vertical direction, the discharge opening in the receiving portion and collides with free falling developer through the discharge opening to decompose the developer.

6 Claims, 9 Drawing Sheets

(a)

(b)

DEVELOPER SUPPLYING APPARATUS

FIELD OF THE INVENTION AND RELATED ART

The present invention relates to a developer supplying apparatus for an image forming apparatus, and more particularly to a developer supplying apparatus for receiving a developer supplied from a supply container and supplying the developer to a receptor.

An image forming apparatus is widely used in which an electrostatic image is developed into a toner image by supplying toner by a developing device, and the toner image is transferred onto a sheet and is heat pressed to be fixed on the sheet. In the image forming apparatus, the toner is consumed by the developing device with the image forming operation, and therefore, a supply developer containing the toner has to be supplied to the developing device from a developer accommodating portion with the image forming operation.

On the other hand, if the supply developer is kept unused in the developer accommodating portion for a long term, the toner particles partly may agglomerate into masses. If the image forming operation is carried out using the developer containing agglomerate masses, the inside portions of the agglomeration masses are not charged electrically, and the electrostatic image on the image bearing member is partly not developed with the result of deterioration of the quality of the output image.

Japanese Laid-open Patent Application 2009-169392 proposes that a stirring blade is provided in the developing device to quickly stir and mix the already existing developer and the newly supplied developer in the developing device and cause frictional contact with an inner wall of the developing device to decompose the agglomerated masses.

In the developing device using a developer containing toner and carrier particles, two stirring screws are normally provided, and therefore, there is no enough space for the provision of the stirring blade exclusively for the purpose disclosed in the prior art. In addition, the stirring screw is optimized to electrically charge the developer, and therefore, the loosening effect to the agglomerate is not large.

Under the circumstances, a proposal has been made in which a space for loosing the agglomerate as disclosed in the prior art is provided in a supply path connecting the developer container and the developing device. However, such an exclusive space results in upsizing of the developing device, and the addition of the stirring blade and the driving mechanism therefore is not preferable from the standpoint of cost of parts, electric power consumption and the deterioration of the developer and so on.

SUMMARY OF THE INVENTION

Accordingly, it is an object of the present invention to provide a developer supplying device with which agglomeration masses of the supply developer can be suppressed without employing an additional stirring blade and/or driving mechanism therefor.

According to an aspect of the present invention, there is provided a supplying apparatus comprising a supply container detachably mountable to a main assembly of an apparatus and configured to supply a developer, with the supply container including an accommodating portion configured to accommodate the developer, a discharge opening configured to discharge the developer out of the accommodating portion, and an expansion-and-contraction portion having a variable inside volume. The developer is supplied from the supply container through the discharge opening using an inside pressure variation of the supply container caused by expansion and contraction of the expansion-and-contraction portion. A receiving portion is configured to receive the developer supplied from the supply container and to form a feeding path along which the developer is fed. A decomposing member is non-rotatably fixed at a position opposing, in a vertical direction, the discharge opening in the receiving portion and configured to collide with free falling developer through the discharge opening to decompose the developer.

Further features of the present invention will become apparent from the following description of exemplary embodiments with reference to the attached drawings.

These and other objects, features and advantages of the present invention will become more apparent upon a consideration of the following description of the preferred embodiments of the present invention taken in conjunction with the accompanying drawings.

DESCRIPTION OF THE EMBODIMENTS

The preferred embodiments of the present invention will be described in conjunction with the accompanying drawings.

<Embodiment 1>

(Image Forming Apparatus)

Figure 1:
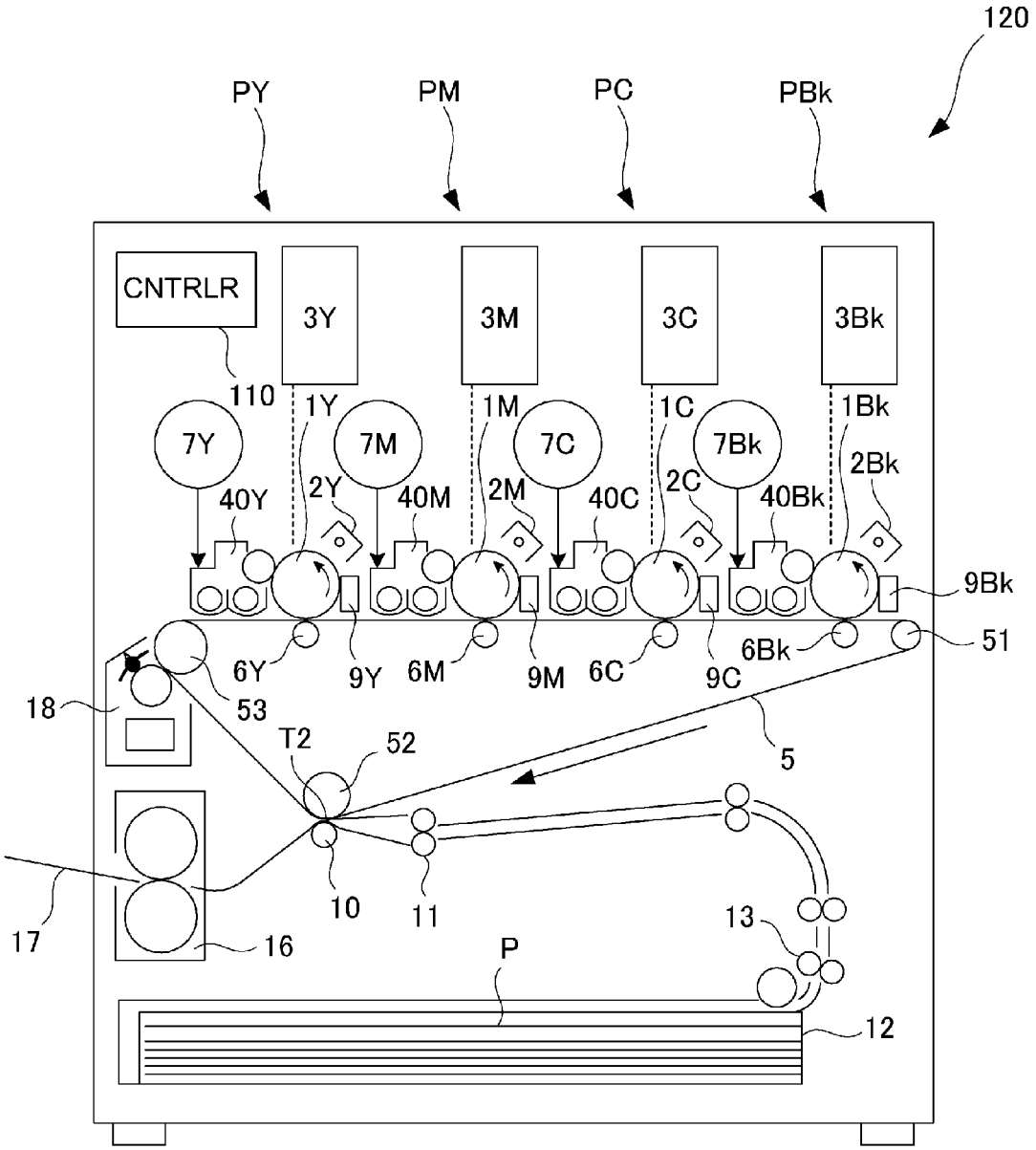
FIG. 1 is an illustration of a structure of an image forming apparatus.

FIG. 1 is an illustration of a structure of an image forming apparatus. As shown in FIG. 1, an image forming apparatus 120 is a full color printer of a tandem type and an intermediary transfer type in which image forming stations PY, PM, PC, PBk are arranged along an intermediary transfer belt 5.

In the image forming station PY, a yellow toner image is formed on a photosensitive drum 1Y and is transferred onto the intermediary transfer belt 5. In the image forming station PM, a magenta toner image is formed on a photosensitive drum 1M and is transferred onto the intermediary transfer belt 5. In the image forming stations PC, PBk, a cyan toner image and a black toner image are formed on photosensitive drums 1C, 1Bk, respectively and are transferred onto the intermediary transfer belt 5.

The four color toner images transferred onto the intermediary transfer belt 5 are fed to a secondary transfer portion T2 and then are secondary-transferred onto a sheet P. A separation roller 13 picks one sheet P up from a cassette 12 and feeds it to registration rollers 11. The registration rollers 11 feeds the sheet P to a secondary transfer portion T2 in timed relation with the toner image on the intermediary transfer belt 5. The sheet P now carrying the toner image is subjected to heat pressing in a fixing device 16, by which the toner image is fixed on the surface of the sheet P.

(Image Forming Station)

The image forming stations PY, PM, PC, PBk have the same structures except that the colors of the toner used in developing devices 40Y, 40M, 40C, 40Bk thereof are different, namely, they are yellow, magenta, cyan and black. In the following description, only the image forming station PY is disclosed, and the descriptions of the image forming stations PM, PC, PBk are omitted for simplicity.

In the image forming station PY, there are provided a corona charger 2Y, an exposure device 3Y, a developing device 40Y, a transfer roller 6Y and a drum cleaning device 9Y around the photosensitive drum 1Y. The photosensitive drum 1Y comprises an aluminum cylinder and a photosensitive layer of an OPC photosensitive material on the outer peripheral surface of the cylinder. The photosensitive drum 1Y rotates in a direction indicated by the arrow at a process speed of 150 mm/sec.

The corona charger 2Y applies charged particles generated by corona discharge to the photosensitive drum 1Y to uniformly charge a surface of the photosensitive drum 1Y to a negative potential. The exposure device 3Y scans the surface of the photosensitive drum 1Y with a laser beam ON-OFF modulated in accordance with a scanning line image signal of a yellow image to form an electrostatic image. The developing device 40Y supplies the toner to the photosensitive drum 1Y to develop the electrostatic image into a toner image. The transfer roller 6Y transfers the toner image carried on the photosensitive drum 1Y onto the intermediary transfer belt 5, by being supplied with a positive DC voltage.

The intermediary transfer belt 5 is supported around a tension roller 53, the inner secondary-transfer roller, and a driving roller 51, and is driven by the driving roller 51 to rotate in the direction indicated by the arrow. The intermediary transfer belt 5 is an endless belt of polyimide resin material provided with an electroconductivity by dispersion of carbon particles. The tension roller 53 urges the intermediary transfer belt 5 outwardly to apply a tension to the intermediary transfer belt 5.

A secondary transfer roller 10 contacts the intermediary transfer belt 5 supported by the inner secondary-transfer roller to provide a secondary transfer portion T2. By applying a positive DC voltage to the secondary transfer roller 10, the toner image is transferred onto the sheet P from the intermediary transfer belt 5.

The drum cleaning device 9Y includes a cleaning blade rubbing the photosensitive drum 1Y to collect untransferred toner deposited on the photosensitive drum 1Y. A belt cleaning device 18 includes a cleaning blade rubbing the intermediary transfer belt 5 to collect the untransferred toner deposited on the intermediary transfer belt 5.

(Developing Device)

Figure 2:
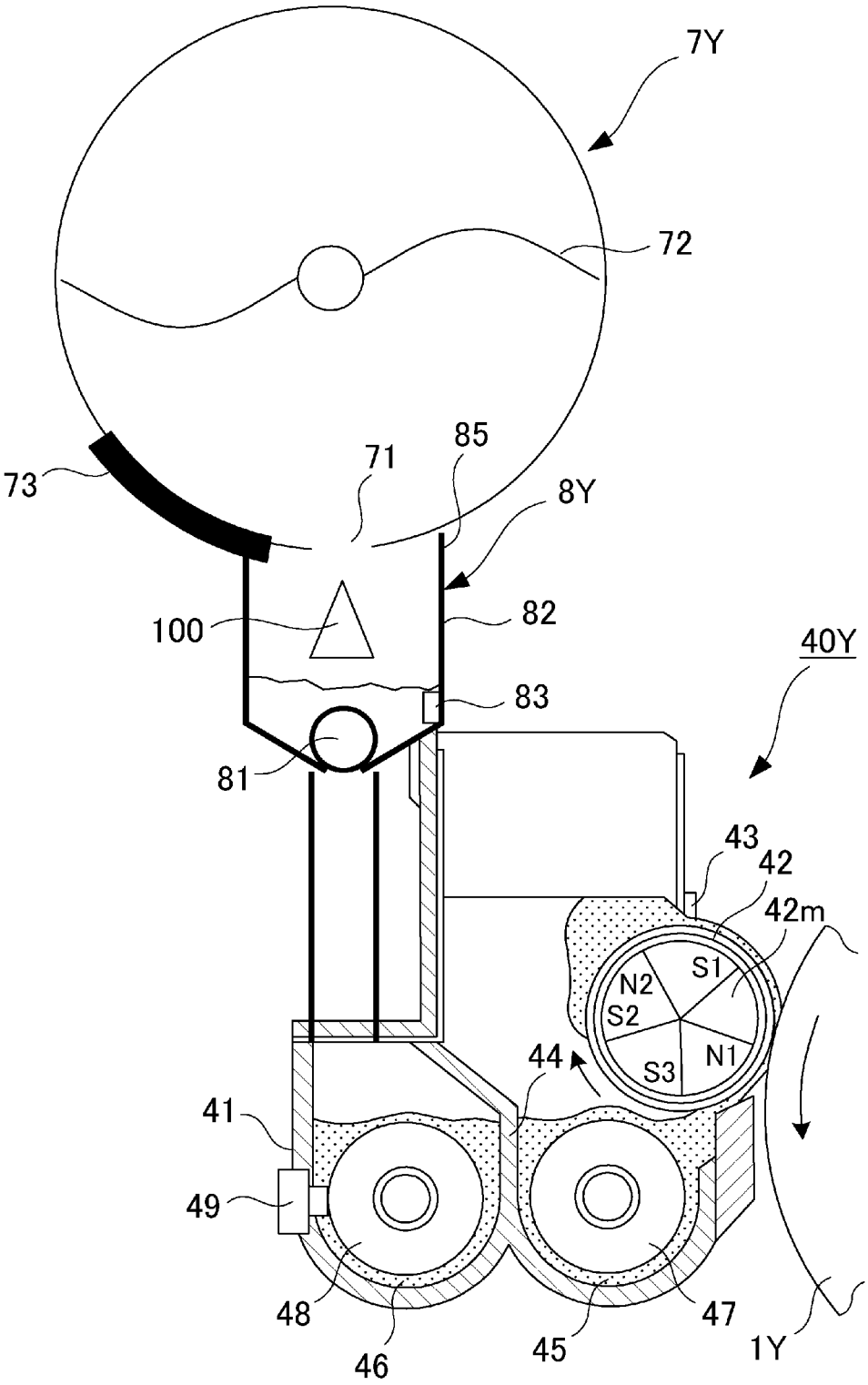
FIG. 2 is an illustration of a structure of a developing device according to Embodiment 1.

FIG. 2 is an illustration of a structure of a developing device according to Embodiment 1. As shown in FIG. 2, a developing container 41 of the developing device 40Y which is of a two component developing system contains a two component developer including toner (non-magnetic) particles and magnetic carrier particles. The developing container 41 is partitioned into a developing chamber 45 and a stirring chamber 46 by a partition 44, and these chambers are in fluid communication with each other through openings provided at the opposite end portions of the partition 44 to constitute a circulation path.

The developing chamber 45 is provided with a first feeding screw 47, and the stirring chamber 46 is provided with a second feeding screw 48. By the rotations of the first feeding screw 47 and the second feeding screw 48, the developer is fed in the opposite directions along the axial direction, so that the developer is circulated between the developing chamber 45 and the stirring chamber 46. In this manner, the developer is circulated while being stirred, during which the toner particles are electrically charge to the negative polarity, and the carrier particles are charged to the positive polarity.

The developing container 41 is provided with an opening in a developing zone opposing to the photosensitive drum 1Y, so that a rotatable developing sleeve 42 is exposed to the photosensitive drum 1Y through the opening. The developing sleeve 42 carries the developer provided from the developing container 41. A regulating blade 43 is provided to regulate a height of chains of the developer carried on the developing sleeve 42. Inside the developing sleeve 42, a magnet roller 42*m* is provided non-rotatably.

The developing sleeve 42 rotates in the direction indicated by the arrow, while carrying the developer. By the function of the magnet roller 42*m*, a magnetic brush of the developer is formed on the developing sleeve 42. The magnetic brush of the developer is cut to an even height by the regulating blade 43, by which a toner layer of a uniform toner layer thickness is formed on the developing sleeve 42. The developer carried on the developing sleeve 42 forms a magnetic brush in the developing zone opposing the photosensitive drum 1Y to rub the photosensitive drum 1Y. The developing sleeve 42 is supplied with an oscillating voltage in the form of a negative DC voltage superimposed with an AC voltage, by which the toner is transferred from the magnetic brush onto the electrostatic image of the photosensitive drum 1Y, so that the electrostatic image is developed.

In this embodiment, the developing sleeve 42 as a diameter of 20 mm, and the photosensitive drum 1Y has a diameter of 40 mm. A gap between the developing sleeve 42 and the photosensitive drum 1Y in a closest region is approximately 310 μm. A rotational frequency of the developing sleeve 42 during the image formation is 229 rpm. A peripheral speed ratio of the developing sleeve 42 relative to the photosensitive drum 1Y is 160%.

(Developer Supplying Apparatus)

As shown in FIG. 2, with the image forming operation, the toner is consumed from the developer in the developing device 40Y with the result that the toner content in the developer decreases. A weight ratio of the toner in the developer, in other words a ratio of a weight of the toner particles relative to a total weight of the carrier particles and the toner particles is called toner content (T/D ratio). A controller 110 is provided to control a toner container 7Y to supply the toner into the developing container 41 so as to maintain a constant toner content of the developer in the developing device 40Y.

The toner container 7Y has a length of approx. 300 mm, a diameter of 100 mm, and functions to accommodate the toner to be supplied into the developing device 40Y. The toner container 7Y is provided with a discharge opening 71 for discharging the toner, in a lower portion at the front side. The toner container 7Y is provided with a stirring blade 72 which rotates to stir and feed the toner toward the discharge opening 71, and finally discharges the toner through the discharge opening 71.

Right below the discharge opening 71, there is provided a hopper portion 8Y for temporarily storing the discharged toner. The toner discharged from the toner container 7Y is temporarily stored in the hopper portion 8Y. At the top portion of the hopper portion 8Y, which is an example of the developer supplying apparatus, there is provided a mounting and demounting portion 85 to which the toner container 7Y is mountable. At the bottom portion of the hopper portion 8Y, there is provided a supplying screw 81 for feeding and supplying the toner into the developing device 40Y. The supplying screw 81 is provided in the toner feeding path extending from the hopper portion 8Y to the developing device 40Y.

The supplying screw 81 extends from the hopper portion 8Y toward the rear side. The supplying screw 81 feeds the toner by the rotation to a rear side portion of the stirring chamber 46 of the developing device 40Y to supply the toner into the developing device 40Y. The supplying screw 81 is a screw member which comprises a center shaft having a diameter of Φ4 mm and comprises a blade having an outer diameter of Φ10 mm. The amount of the toner supply to the developing device 40Y is different if the rotation time of the supplying screw 81 is different.

A piezoelectric sensor 83 is provided on a wall surface of a toner storing container 82 of the hopper portion 8Y. An output of the piezoelectric sensor 83 changes with presence or absence of the toner adjacent thereto to detect a remaining toner amount inside the toner storing container 82.

The controller 110 prompts the toner discharging from the toner container 7Y when the detection of the piezoelectric sensor 83 indicates shortage of the remaining toner amount in the toner storing container 82. When the remaining toner amount in the toner storing container 82 detected by the piezoelectric sensor 83 does not increase even when the stirring blade is rotated, the controller 110 discriminates "no-toner" in the toner container 7Y.

The toner container 7Y is dismountably mounted to the image forming apparatus 120 at the position above the developing device 40Y. The image forming apparatus 120 mounts the toner container 7Y containing the toner, so as to be mountable to a dismountable from the developing device 40Y. When the toner container 7Y is dismounted from the image forming apparatus 120, a shutter member 73 slides to close the discharge opening 71 to prevent the leakage of the toner.

(Toner Supply Control)

Figure 3:
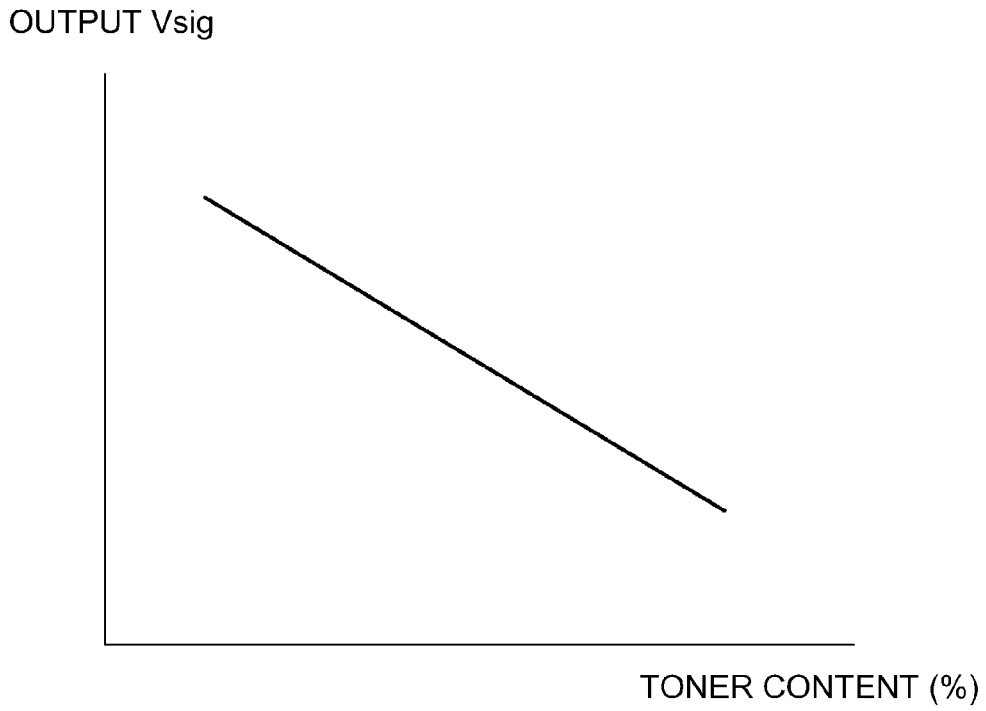
FIG. 3 is an illustration of an output of an inductance sensor.

FIG. 3 is an illustration of an output of an inductance sensor. An apparent magnetic permeability of the developer mainly comprising carrier and toner particles changes with the number of carrier particles per unit volume. The inductance sensor 49 is disposed on the side surface of the stirring chamber 46 of the developing container 41 to detect the apparent magnetic permeability of the developer.

As shown in FIG. 3, a detection output (Vsig) of the inductance sensor 49 changes substantially linearly in accordance with the toner content. The detection output of the inductance sensor 49 corresponds to the toner content of the developer in the developing container 41. When the toner content of the developer increases, the ratio of the toner in the developer increases, and therefore, the apparent magnetic permeability of the developer decreases, and the detection output of the inductance sensor 49 decreases. On the other hand, when the toner content of the developer decreases, the apparent magnetic permeability of the developer increases, and therefore, the detection output of the inductance sensor 49 increases.

The controller 110 compares the detection output Vsig of the inductance sensor 49 with an initial reference signal Vref, and calculates a toner supply amount on the basis of a calculation result of the difference (Vsig−Vref). The controller 110 controls the hopper portion 8Y so that the detection output (Vsig) of the inductance sensor 49 approaches to the initial reference signal Vref. The initial reference signal Vref is a voltage output corresponding to (the toner content in) the initial state, and is stored in a memory tag (unshown) attached to the developing device 40Y.

Wherein Vsig−Vref>0, it means that the toner content of the developer is lower than a target toner content, and therefore, the controller 110 determines a necessary toner supply amount in accordance with the difference and determines a rotation time of the supplying screw 81. With increase of the difference between Vsig and Vref, the amount of the toner supply increases. On the other hand, when Vsig−Vref≥0, it means that the toner content of the developer is higher than the target toner content, and therefore, the rotation of the supplying screw 81 is stopped, and the toner content decreases with consumption of the toner by the image forming operation.

As described above, the controller 110 detects the toner content of the developer on the basis of the detection output (Vsig) of the inductance sensor 49 and controls the toner supply from the hopper portion 8Y. The controller 110 meters the toner into the developing device 40Y by controlling the rotation time period of the supplying screw 81 in accordance with the toner supply signal.

(Toner Agglomeration Mass)

Recently, the toner used in the image forming apparatus has a low temperature fixing property from the stand point of energy saving. Such low temperature fixing property toner tends to form into agglomeration masses under a high-temperature condition, as compared with conventional high temperature fixing property toner. When the low temperature fixing property toner is kept unused in the toner container 7Y for a long term under a high temperature condition, a number of agglomeration masses may be produced in the toner container 7Y.

Wherein such a toner container 7Y is mounted to the image forming apparatus 120, the agglomeration masses are supplied into the developing device 40Y. If the agglomeration mass is not decomposed in the stirring path in the developing device 40Y, and the agglomeration mass is supplied to the developing sleeve 42, the latent image is developed with un-charged toner, with the results of production of a fixed image having a contamination.

Therefore, it is preferable to decompose the agglomeration masses before being supplied into the developing device 40Y. That is, it is preferable that the number of toner agglomeration masses before the toner is supplied into the developing device 40Y.

In view of this, in the following embodiment, a means (decomposing member 100) for decomposing the toner agglomeration masses at a position right below the discharge opening 71 of the toner container 7Y in the hopper portion 8.

(Decomposing Member)

Figure 4:
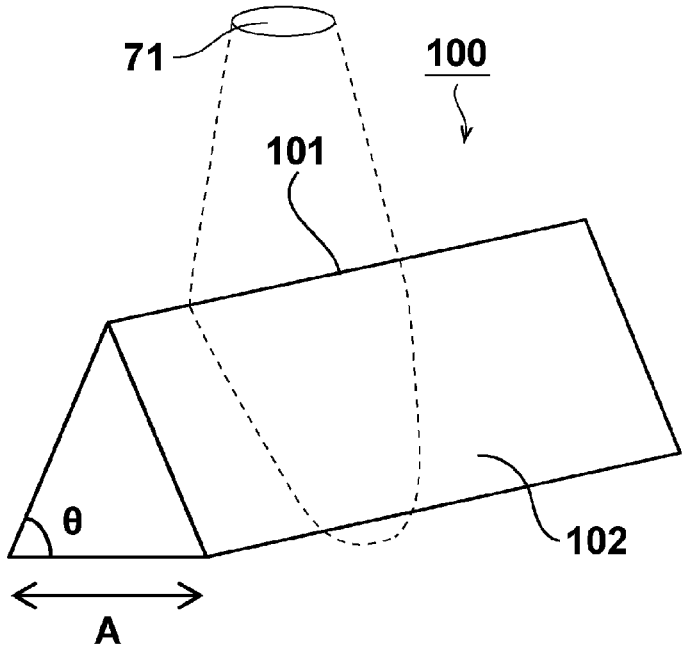
FIG. 4 is a perspective view of a decomposing member.
Figure 5:
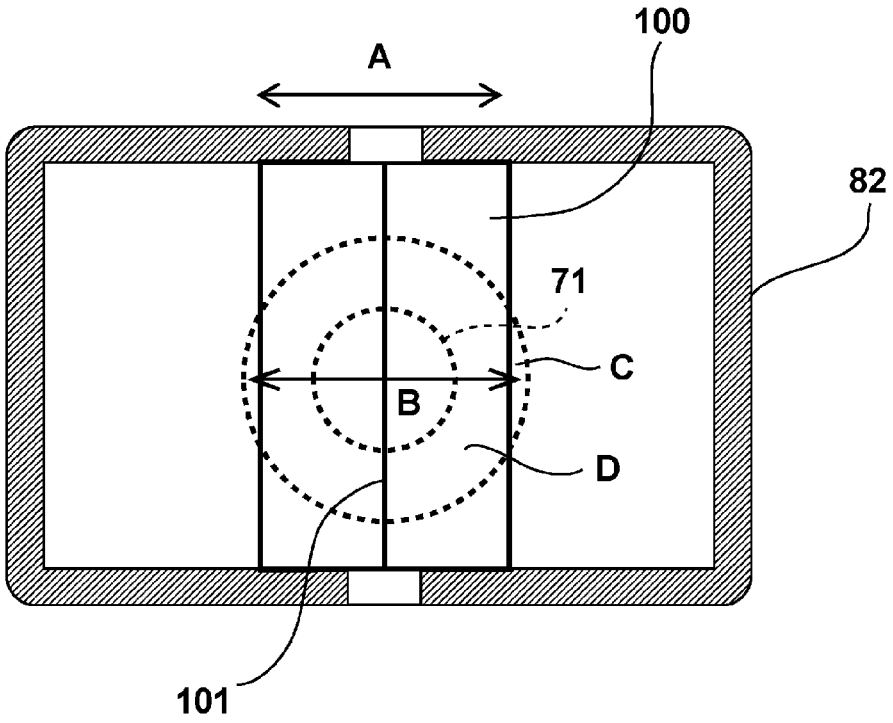
FIG. 5 is a top plan view of the decomposing member.
Figure 6:
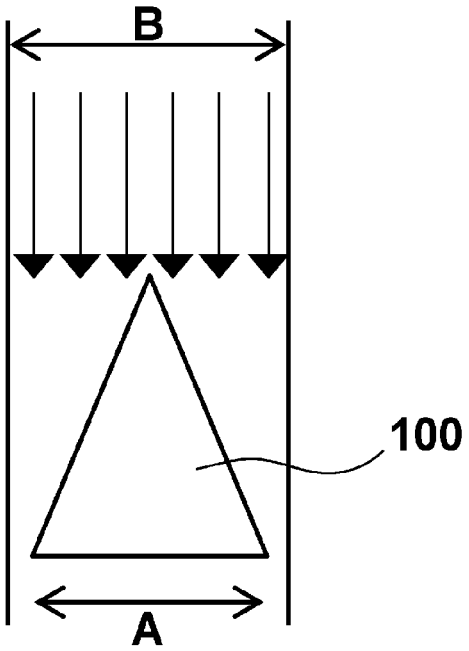
FIG. 6 is the side view of the decomposing member.
Figure 7:
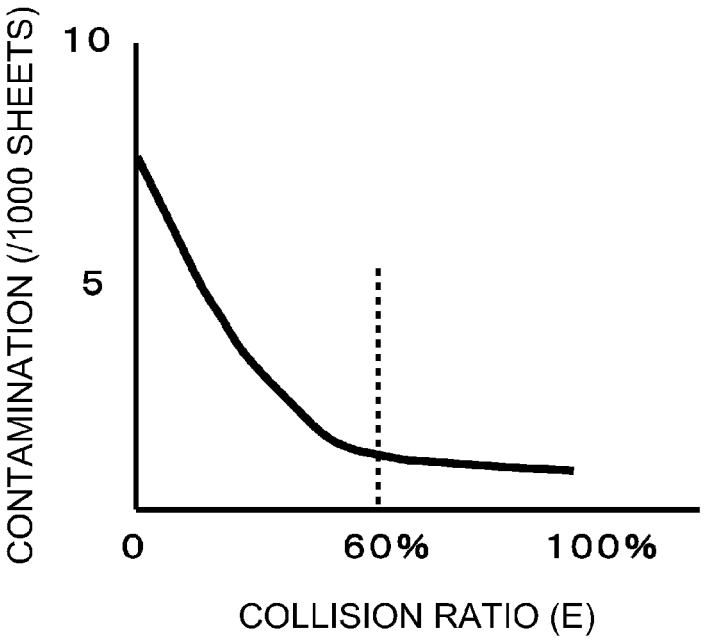
FIG. 7 is an illustration of a relationship between a clashing or collision ratio and an image quality.

FIG. 4 is a perspective view of a decomposing member as an abutment. FIG. 5 is a top plan view of the decomposing member. FIG. 6 is the side view of the decomposing member. FIG. 7 is an illustration of a relationship between a clashing or collision ratio and an image quality. As shown in FIG. 4, an inclination angle θ of a side surface 102 of the decomposing member 100 relative to a horizontal surface is larger than an angle of rest of the supply developer. The side surface 102 extends beyond a region of the discharge opening 71 projected in the perpendicular direction. A shortest distance from the discharge opening 71 to the side surface 102 is not less than 20 mm.

As shown in FIG. 2, the toner container 7Y, which is an example of a first supply portion (developer accommodating portion), is capable of supplying the developer by letting the developer fall from the predetermined supply position. Through the discharge opening 71, the supply developer falls from the toner container 7Y. The hopper portion 8Y (supply portion) which is an example of a second supply portion (receiving portion) receives and accommodates the developer supplied from the toner container 7Y and is capable of supplying the accommodated developer into the developing device 40Y (developing zone) which is an example of a receptor.

The decomposing member 100 which is an example of the decomposing member is provided in a falling path of the developer from the toner container 7Y at a level higher than a top level of the developer powder in the second accommodating portion. To the decomposing member 100, the developer falling from the toner container 7Y through the discharge opening 71 clashes or collides at the inclined surfaces to decompose the masses. The decomposing member 100 has a triangular pyramid configuration, and an apex edge is disposed right below the discharge opening 71.

As shown in FIG. 4, the material of the decomposing member 100 is POM, the configuration is triangular prism-like, and the apex edge 101 is at a top. Two side surfaces 102 crossing at the apex edge 101 are inclined surfaces having inclination angles of θ=60°, respectively. Here, the inclination angle is an angle formed between the horizontal surface and the side surface 102. The bottom surface has a width A which is 24 mm. A distance between the discharge opening 71 and the apex edge 101 of the decomposing member 100 is 28 mm.

As shown in FIG. 2, the toner falling from the toner container 7Y through the discharge opening 71 clashes against the decomposing member 100 disposed right below the discharge opening 71. The agglomerated masses of the developer self-decompose in the process of clashing against the inclined surfaces and rolling down thereon. The discharge opening 71 of the toner container 7Y is disposed right above the apex edge 101 of the decomposing member 100. The size of discharge opening 71 is Φ10 mm, and therefore, a perpendicular projection region of the discharge opening 71 completely overlaps the decomposing member 100.

As shown in FIG. 5, the region of projection of the discharge opening 71 on the decomposing member 100 completely overlaps the decomposing member 100.

Therefore, when an expansion of the flow of toner discharged from the discharge opening 71 is small, the collision (clashing) ratio of the toner relative to the decomposing member 100 can be made closer to 100%.

As shown in FIG. 6, the diameter of the expanded toner flow is B, with which the toner clashes against the decomposing member 100. The diameter B has been confirmed as being substantially Φ28 mm at the position of the clashing. The expanded diameter B is determined by taking the flow of the toner by a video camera and calculating it from the taken image. More specifically, a scale is placed behind the toner flow, and the toner flow is photographed together with the scale. Such moving pictures are taken with different photo-taking angles, and the acquired width data of the toner flow are averaged to determine the diameter B.

As shown in FIG. 6, it is desired that all the discharged toner clashes against the decomposing member 100, in order to clash the agglomeration masses of the toner. Therefore, it is desired that the decomposing member 100 is large to provide a wide clashing surface. However, if the decomposing member 100 is too large, a gap from the wall surface 82 of the hopper portion is not enough with the result of clogging of the toner, and therefore, the size of the decomposing member 100 is to be limited.

In Embodiment 1, a cross-sectional area C at the time of clashing of the toner flow discharged from Φ28 mm opening is 615.44 mm^2, and an area D of the clashing surface of the decomposing member 100 is 576.38 mm^2. As shown in FIG. 5, the area D of the clashing surface of the decomposing member 100 is such an area of the Φ28 mm toner flow projected on the decomposing member 100 as overlaps the decomposing member 100. More particularly, the area D of the clashing surface of the decomposing member 100 is the area of overlapping between the broken line circle with decomposing member 100.

A ratio between an area (D) of the clashing surface and a cross-sectional area (C) of the toner flow is called "clashing ratio" or "collision ratio". The collision ratio E indicates a ratio of the discharged toner directly clashing on the decomposing member 100, and in Embodiment 1, approx. 93.6% of the toner discharged through the discharge opening 71 clashes against the decomposing member 100.

$$E=D/C=576.38/615.44=93.6\ (\%)$$

The relationship between the collision ratio and the image quality are investigated by changing the size of the decomposing member 100. The image quality is assessed on the basis of number of contamination spots on 1000 prints having an image ratio of 5%.

As shown in FIG. 7, with decrease of the collision ratio E, the number of the contamination spots increases. Particularly, if the collision ratio E becomes less than 60%, the number of the contamination drastically increases. From the results, it is desired that the collision ratio E is not less than 60%.

(Angle of Rest of Toner)

As shown in FIG. 2 the toner clashes against the decomposing member 100, descending and sliding on the side surfaces 102 of the decomposing member 100, and is temporarily accumulated in the bottom portion of the hopper portion 8Y. An inclination angle θ of the side surface 102 of the decomposing member 100 is desirably not less than the angle of rest of the toner. When the inclination angle θ of the side surface 102 is smaller than the angle of rest of the toner, the clashed toner tends not to slide down on the side surface 102 but to accumulate. If the side surface 102 is covered with the toner, the then falling toner is unable to clash against the side surface 102, and therefore, the decomposition of the agglomeration mass by the direct collision, friction, rolling and sliding can not be expected, which is not preferable. If the toner accumulates further on the side surface 102, the accumulated toner grows upward with the possible result of toner packing The angle of rest is assessed with respect to toners A-D.

TABLE 1

| Toner | Vol. average particle size | Condition of external addition | Angle of rest |
|---|---|---|---|
| A | 7 μm | I | 18° |
| B | 6.5 μm | II | 25° |
| C | 7 μm | III | 33° |
| D | 5.5 μm | IV | 40° |

As shown in Table 1, the toners A-D are all cyan toner, but volume average particle sizes and external addition conditions thereof are different from each other. The angles of rest, indicating a flowability, of the toners A-D are measured as property values.

For the measurement of the angle of rest, the toner powder is let to fall on a disk having a diameter of 8 cm through a funnel, and an angle of the conical accumulated layer is directly measured using a protractor. In the supply of the developer at this time, a sieve having an aperture of 608 μm (24 mesh) is placed above the funnel, and the toner powder is placed on the sieve, wherein the toner is supplied into the funnel by imparting vibration.

On the basis of the results of the experiments (Table 1), the inclination angle of 60° is employed in Embodiment 1, so that even when D toner having the largest angle of rest among the tested toners is used, the accumulation can be assuredly avoided.

A surface roughness of the side surface 102 is desirably small since then the toner tends to descend, in order to assuredly avoid the accumulation of the toner, the surface roughness of Ra of the side surface 102 is desirably not more than 2.0.

(Effects of Embodiment 1)

Figure 8:
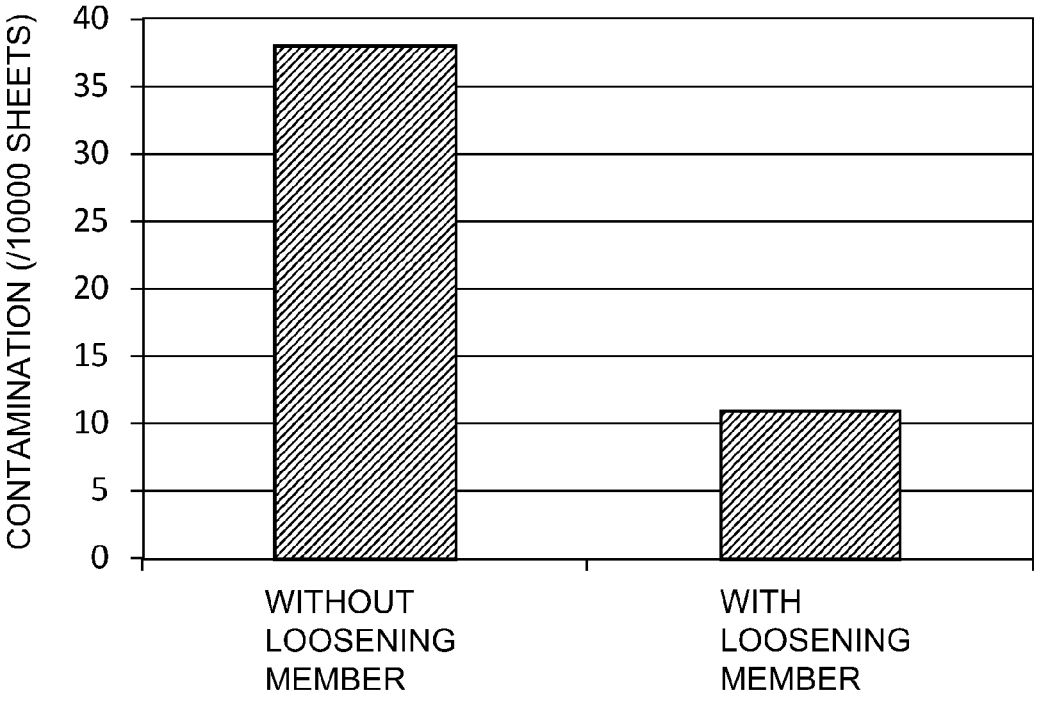
FIG. 8 is an illustration of an effect of use of the decomposing member.

FIG. 8 is an illustration of an effect of use of the decomposing member. As shown in FIG. 2, using the image forming apparatus (100, FIG. 1), the number of contamination spots in the fixed images have been checked in 10000 continuous image formations in the case of using the decomposing member 100 and in the case of not using the decomposing member 100.

As shown in FIG. 8, in Embodiment 1, by using the decomposing member 100, the number of the contamination spots could be reduced down to approx. 29% (reduction rate: 71%). Thus, by the provision of the decomposing member 100, the number of the agglomeration masses of the toner supplied into the developing device 40Y can be significantly reduced. Therefore, the image contamination attributable to the toner agglomeration masses can be prevented effectively. The suppressed image contamination is effective to form high quality images stably.

According to Embodiment 1, the agglomeration mass can be decomposed effectively with a simple, easy and low cost structure even if the toner is kept unused in the toner container 7Y under high temperature and high humidity conditions for a long term. This means that the toner container 7Y may be kept under high temperature and high humidity conditions for a long term. Even if a toner container 7Y containing a number of agglomeration masses of the toner is used, the image contamination attributable to the agglomeration masses reaching into the developing device 40Y.

According to Embodiment 1, no additional structure other than the decomposing member 100 is required. More particularly, a stirring member or a driving mechanism for driving the stirring member is required. Furthermore, no motor or driving gear is required, and therefore, the general arrangement is simple without increase of cost of parts or assembling cost. Because the motor or the stirring blade is not used, a configuration providing the maximum effect can be employed in the limited space. As compared with the structure disclosed in Japanese Laid-open Patent Application 2009-169392, there is no stirring member which rotates contacting the wall surface of the developing container, and therefore, the production of the agglomeration mass of the toner due to the heat and mechanical stress caused by the friction can be avoided.

According to Embodiment 1, the angle of rest is not less than 60°, by which the toner packing can be avoided with a high decomposing power. The angle of rest of not less than 60° is effective to prevent accumulation of the toner on the decomposing member 100, by which the toner packing can be avoided.

According to Embodiment 1, high quality fixed images can be stably formed without image defects attribute double to the agglomeration mass of the toner.

<Embodiment 2>

Figure 9:
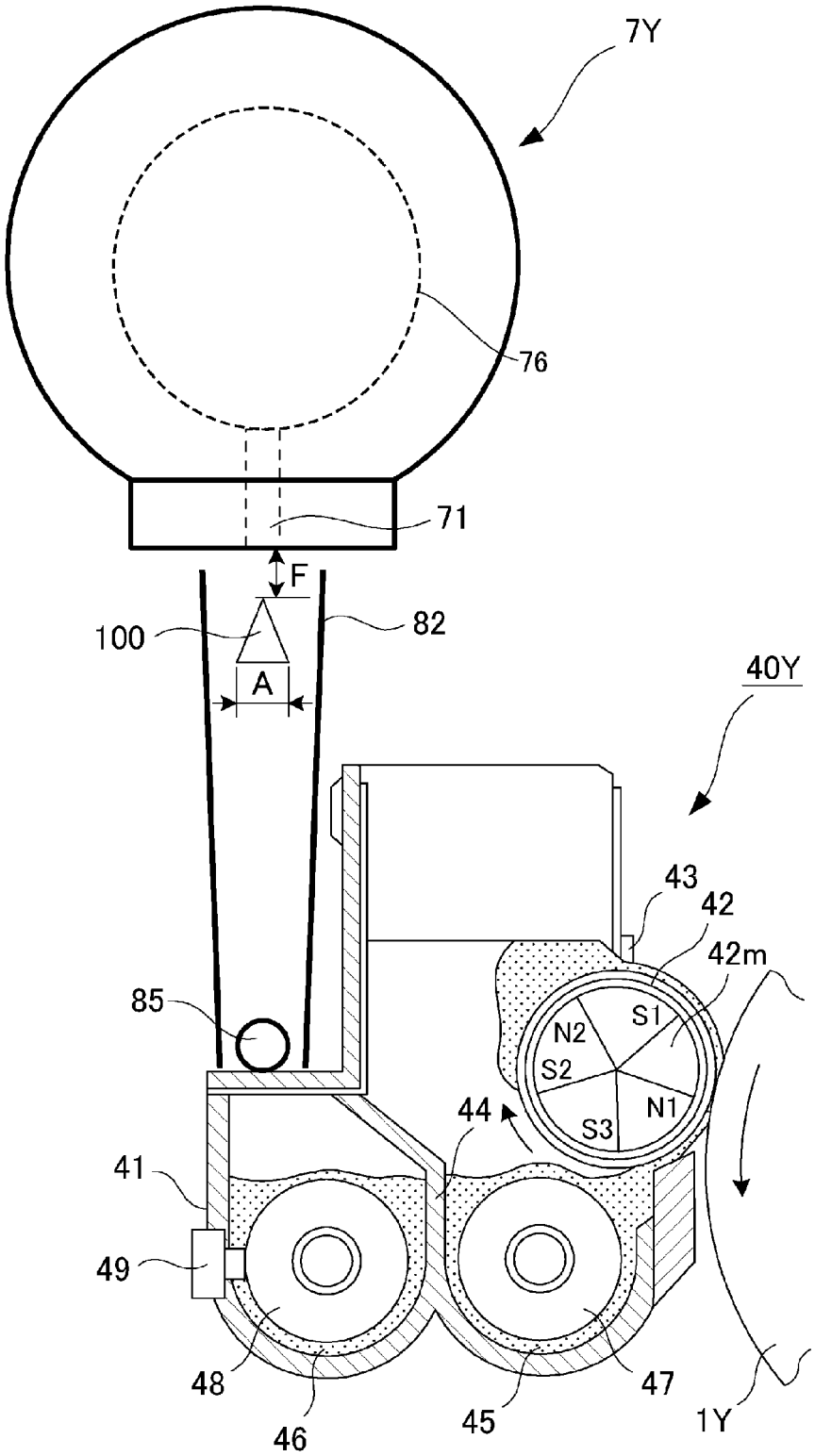
FIG. 9 is an illustration of a structure of a developing device according to Embodiment 2.

FIG. 9 is an illustration of a structure of a developing device according to Embodiment 2. Embodiment 2 is different from Embodiment 1 in the structure of the toner container and toner supply method to the developing device. As shown in FIG. 2, in Embodiment 1, a stirring blade 72 is operated to supply the toner out of the toner container 7. A hopper portion 8Y is provided below a decomposing member 100. As shown in FIG. 9, in Embodiment 2, the toner is discharged from the toner container 7Y by operating a pump portion 76 of a bellow pump. No hopper portion is provided below the decomposing member 100. In the description of this embodiment, the same reference numerals as in Embodiment 1 are assigned to the elements having the corresponding functions in this embodiment, and the detailed description thereof is omitted for simplicity, since the structures are generally the same, except for the above-described points.

(Developer Supplying Apparatus)

Figure 10:
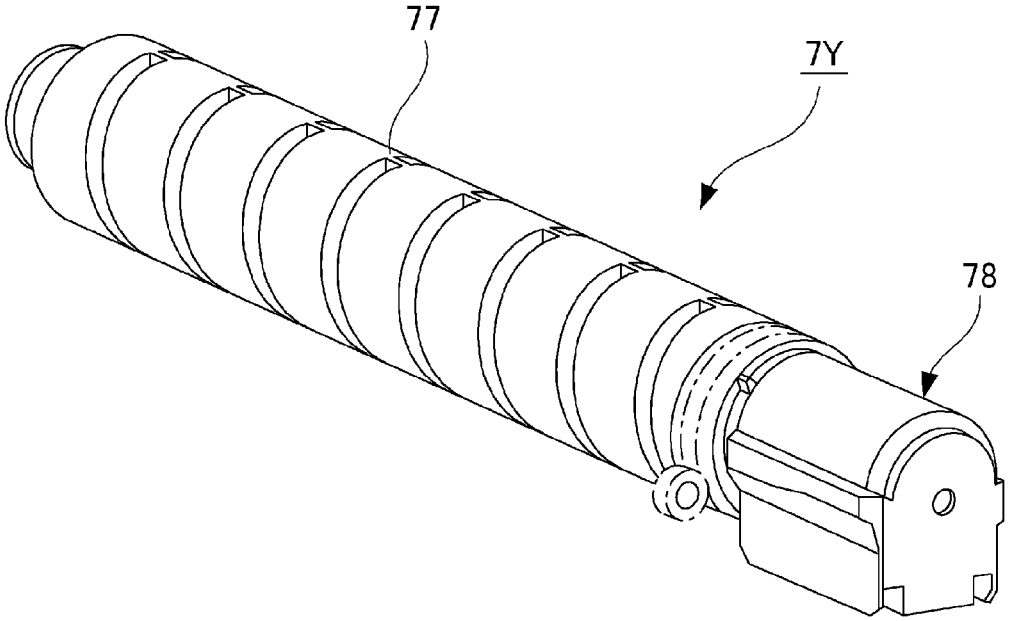
FIG. 10 is an illustration of a toner container.
Figure 10:
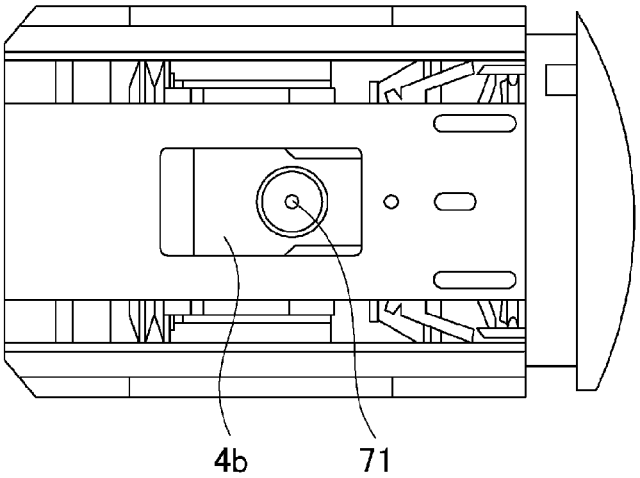
Figure 11:
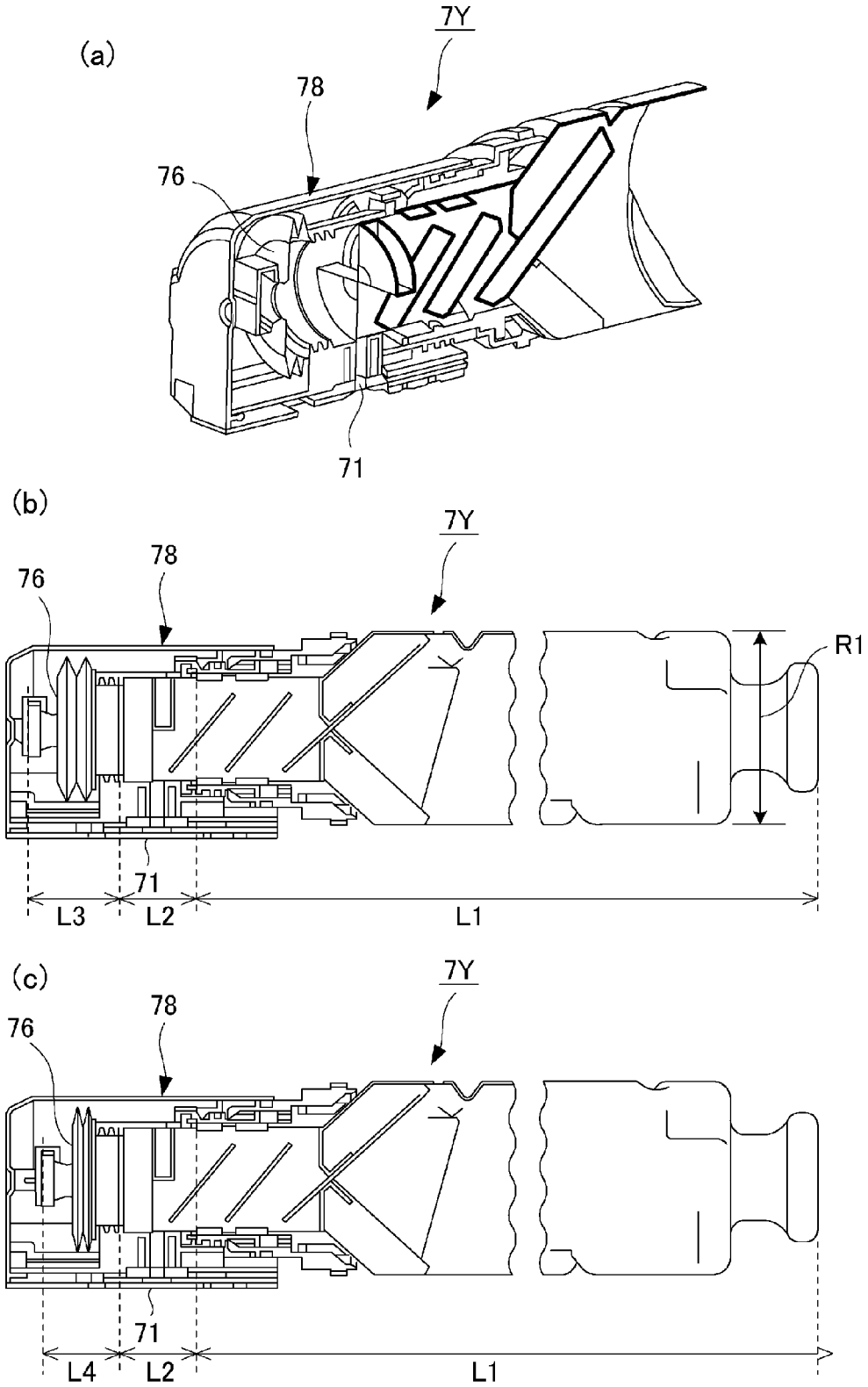
FIG. 11 is an illustration of a bellow pump.

FIG. 10 is an illustration of a toner container. FIG. 11 is an illustration of a bellow pump. In FIG. 10, (a) is a perspective view of a whole toner container, and (b) is an enlarged view of a neighborhood of a discharge opening of the toner container. In FIG. 11, (a) is a perspective view of a section of the toner container, (b) shows a state in which a pump portion is expanded to a maximum extent, and (c) shows a state in which the pump portion is contracted to the maximum extent.

As shown in FIG. 9, in Embodiment 2, the toner container 7Y discharges the toner using the pump portion 76 of the bellow pump. The pump portion 76 downwardly discharges a predetermined amount of the toner particles through the discharge opening 71 by each reciprocation of the bellow pump, and the toner supply amount into the developing device 40Y is controlled by the number of reciprocations of the bellow pump. Therefore, in this embodiment, the toner content in the developing device can be maintained stably even if the toner is directly supplied into the developing device 40Y without using a hopper portion and supplying screw. In Embodiment 2, it is not the case that the toner is temporarily stored in the hopper portion (8Y, FIG. 2) and then it is supplied into the developing device 40Y, but the toner discharged from the toner container 7Y is quickly supplied into the developing device 40Y.

Therefore, in this embodiment, as shown in FIG. 2, no hopper portion 8Y for temporarily storing the toner is discharged from the toner container 7Y, before the toner is supplied into the developing device 40Y is provided. That is provided no supplying screw 81 for metering the toner into the developing device 40Y.

As shown in part (a) of FIG. 10, a toner accommodating portion 77 of the toner container 7Y is hollow-cylindrical, and is provided with a container space for accommodating the toner. The shape of the toner accommodating portion 77 is not limited to circular cylindrical shape. The cross-sectional shape thereof may be non-circular such as elliptical or polygonal shape, as long as the rotation thereof in the toner supply step is restricted.

The cylindrical and rotatable toner accommodating portion 77 of the toner container 7 is provided at one longitudinal end portion side with a non-rotatable flange portion 78. The toner accommodating portion 77 rotates relative to the flange portion 78, by which the toner is fed toward the flange portion 78 in the toner accommodating portion 77. As shown in part (b) of FIG. 10, the toner is discharged downwardly with air flow from a sealed chamber 4*b* of the flange portion 78 through the discharge opening 71.

As shown in part (a) of FIG. 11, the flange portion 78 functions to discharge the toner supplied from the toner accommodating portion 77, into the developing device 40Y, using the pump portion 76.

As shown in part (b) of FIG. 11, the flange portion 78 expands the bellow pump of the pump portion 76 to reduce the pressure in the toner container 7Y to the level lower than the ambient pressure, thus taking the air into the toner container 7Y to fluidize the supply developer.

As shown in part (c) of FIG. 11, the flange portion 78 contracts the bellow pump of the pump portion 76 to raise the pressure in the toner container 7Y to a level higher than the ambient pressure, thus discharging the developer using the pressure difference between the inside and outside of the toner container 7Y.

The flange portion 78 repeats the above-described two steps alternately to stably discharge the developer. In synchronism with the rotation of the toner accommodating portion 77, the pump portion 76 expands and contracts to discharge the toner.

As shown in part (b) of FIG. 11, the toner accommodating portion 77 has a cylindrical shape having a total length L1 of approx. 460 mm and an outer diameter R1 of approx. 60 mm. A region of a discharging portion functioning as a toner discharging chamber of the flange portion 78 has a length L2 of approx. 21 mm. In the most expanded state in the reciprocating range, a total length L3 of the pump portion 76 is approx. 29 mm. As shown in part (c) of FIG. 11, in the most contracted the state, a total length L4 of the pump portion 76 is approx. 24 mm.

The feeding screw 85 rotates in interrelation with the developing sleeve 42 to feed the toner to a predetermined position with respect to the longitudinal direction of the developing device 40Y, and let the toner fall into the developing device 40Y.

(Toner Supply Control)

In Embodiment 2, similarly to Embodiment 1, the toner supply amount is determined in accordance with an output signal of the inductance sensor 49 provided in the developing device 40Y. When the voltage output Vsig of the inductance sensor 49 satisfies Vsig−Vref>0, it means that the toner content of the developer is lower than the target toner content, and therefore, a necessary toner supply amount is determined in accordance with the difference therebetween. However, since there is provided no supplying screw 81, the rotation time of the supplying screw 81 not calculated. Instead, a number of rotations of the toner accommodating portion 77 required for the necessary toner supply amount is determined, and the determined number of rotations of the toner accommodating portion 77 is carried out.

(Decomposing Member)

Right below the discharge opening 71 of the toner container 7Y, there is provided a decomposing member 100, similarly to Embodiment 1. As shown in FIG. 4, the decomposing member 100 is made of POM and has a triangular prism-like shape with the apex edge 101 placed right below the discharge opening 71, wherein the inclination angles of the side surfaces 102 crossing at the apex edge 101 are θ=60°, respectively.

As shown in FIG. 10, in this embodiment, the bottom surface has a width A of 10 mm which is smaller than the width A=24 mm in Embodiment 1. A distance from the discharge opening 71 to the apex edge of the decomposing member 100 in this embodiment is 22 mm and is smaller than E=28 mm in Embodiment 1. The discharge opening 71 of Embodiment 2 is circular and has a diameter of Φ3 mm which is smaller than Φ10 mm in Embodiment 1.

In Embodiment 2, when the toner discharged through the discharge opening 71 having a diameter of Φ3 mm clashes against the decomposing member 100, a diameter B of the expanded flow of the toner is approximately Φ8 mm which is significantly smaller than diameter B=Φ28 mm in Embodiment 1 (measured using the above-described video record measuring method). In Embodiment 2, a cross-sectional area (C) upon the clashing of the discharged toner flow is 50.24 $mm^2$, and the area (D) of the clutching surface of the decomposing member is 50.24 $mm^2$ (C=D). The collision ratio E here is E=D/C=100%, and therefore, 100% of the toner discharged from the discharge opening 71 clashes against the decomposing member 100.

(Effects of Embodiment 2)

Figure 12:
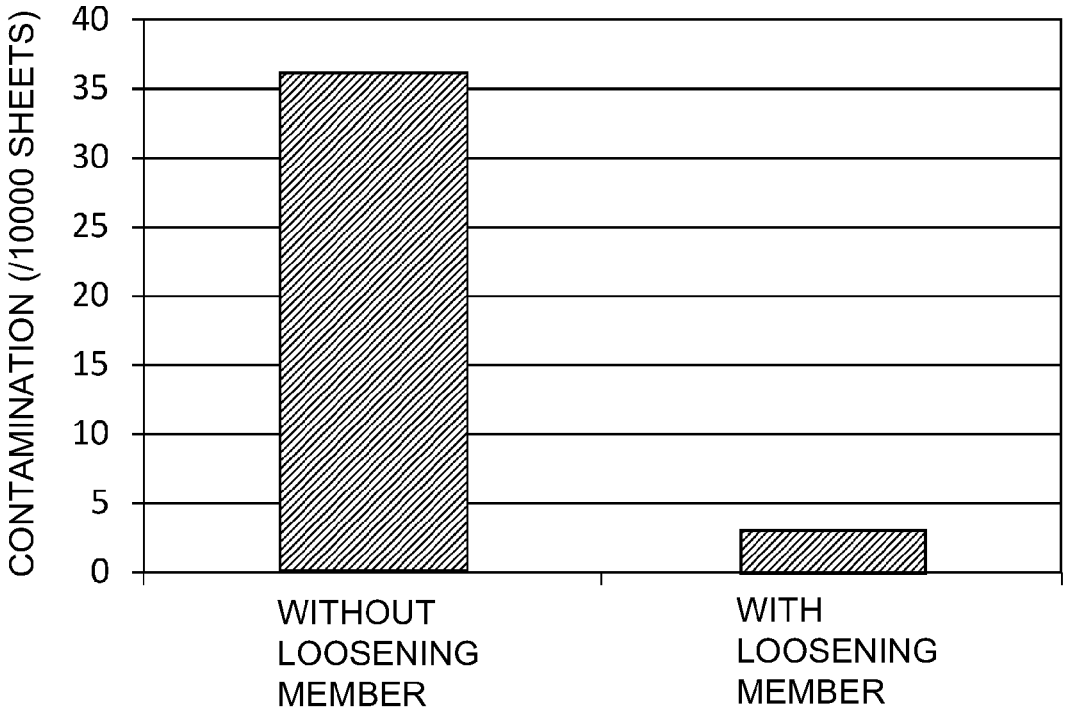
FIG. 12 is an illustration of an effect of use of the decomposing member.

FIG. 12 is an illustration of an effect of use of the decomposing member. As shown in FIG. 9, using the image forming apparatus (100, FIG. 1), the number of contamination spots in the fixed images have been checked in 10000 continuous image formations in the case of using the decomposing member 100 and in the case of not using the decomposing member 100.

As shown in FIG. 12, in Embodiment 2, by using the decomposing member 100, the number of the contamination spots could be reduced down to approx. as 8% (reduction rate: 92%).

In Embodiment 2, the non-rotatable flange portion 78 discharges the toner which is an example of the supply developer toward the side surfaces 102 with the blowing of the air through the discharge opening 71. The agglomeration masses, if any, of the toner discharged through the discharge opening 71 are decomposed by the clashing against the decomposing member 100. Here, the toner discharged through the discharge opening 71 by the pressure difference caused by the expansion and contraction of the pump portion 76 has a certain degree of flow speed together with the air flow, when clashing against the decomposing member 100.

Therefore, as compared with the case of Embodiment 1 in which the toner clashes only by the free fall, an impact force to the agglomeration mass upon the clashing against the decomposing member 100 is large in Embodiment 2 so that the agglomeration mass decomposing power is strong. That is, the decomposing power is stronger in Embodiment 2 than in Embodiment 1. Therefore, the occurrence of the image contamination can be significantly reduced.

In Embodiment 2, the diameter of the discharge opening 71 is so small that 100% of the toner discharged through the discharge opening 71 clashes against the inclined surface of the side surfaces 102 of the decomposing member 100. Therefore, the number of agglomeration masses circumventing the decomposing member is reduced, which also enhances the agglomeration mass decomposing performance.

In Embodiment 2, since the diameter of the discharge opening 71 is small, the diameter B of the expanded toner flow from the discharge opening 71 is small. When the diameter B of the expanded toner flow it small, the size of the decomposing member 100 can be reduced, so that the developing device 40Y and the image forming apparatus 120 can be downsized.

In Embodiment 2, the parts around the hopper portion and the supplying screw may be omitted, and therefore, the downsizing and low cost of the developing device 40Y can be expected more than in Embodiment 1. The hopper portion for temporarily storing the toner and the supplying screw may be omitted, so that the main assembly cost can be reduced, while the agglomeration masses of the toner can be assuredly decomposed, and the image defect attributable to the agglomeration masses can be avoided.

<Other Embodiments>

Figure 13:
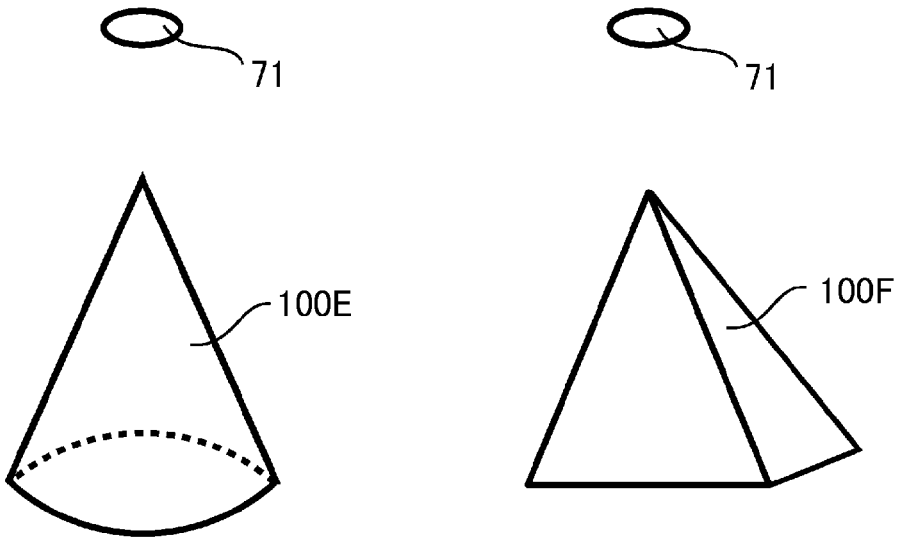
FIG. 13 is an illustration of the decomposing member according to another example.

FIG. 13 is an illustration of the decomposing member according to another example in which the apex is a point rather than the edge.

The present invention is applicable to other structures as long as the structure for decomposing the agglomeration mass of the toner by clashing against the inclined surface.

Therefore, the image forming apparatus may be a drum type, a tandem type, an intermediary transfer type, a recording material feeding member type or the like. The number of the image bearing member, the charging type for the image bearing member, the forming type of the electrostatic image, the one component developer, the two component developer, the supply developer containing 100% of toner, the supply developer containing a predetermined percentage of the carrier, the transfer type may be any. In the foregoing, only the major parts relating to the formation and transferring of the toner image have been described, but the present invention is applicable to various printers, copying machines, facsimile machines, complex machines and other image forming apparatuses.

The photosensitive member may be an organic photosensitive member, an amorphous silicon photosensitive member, inorganic photosensitive member or the like. The photosensitive member may be in the form of a belt. The charging type, the cleaning type and the fixing type may be any.

In Embodiments 1 and 2, the decomposing member has a triangular prism configuration having an apex edge, but another shape such as square prism or polygonal prism shape is usable. Alternatively, a plurality of inclined surfaces of thin plate or thin plates are usable. Further alternatively, a mesh inclined surface having openings larger than the toner particle and smaller than the agglomeration mass can be used.

As shown in FIG. 9, the decomposing member 100 may have a polygonal pyramid or a conical shape with the apex thereof placed right below the discharge opening 71. When the use is made with the shape having an apex, the apex is preferably placed right below the toner discharge opening 71 of the toner container 7. This is because the discharged toner can be clashed against the decomposing member 100 with small variations of clashing speed.

The discharge opening 71 and the decomposing member 100 of the developer supplying apparatus may not be provided in the developing device 40Y. For example, the discharge opening 71 and the decomposing member 100 may be provided in the toner container 7Y so that they can be mounted to and dismounted from the developing device 40Y as a unit. The discharge opening 71 and the decomposing member 100 may not be fixed on the main assembly frame of the image forming apparatus 120.

In the image forming apparatus of the present invention, the falling developer clashes against the decomposing member to be decomposed into the toner particles. Accordingly, the agglomeration mass of the developer can be effectively decomposed without additional stirring blade and/or driving mechanism, so that the development defect attributable to the agglomeration mass can be avoided, thus accomplishing high quality image production.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 174056/2013 filed Aug. 26, 2013, which is hereby incorporated by reference.

What is claimed is:

1. A supplying apparatus comprising:

a supply container detachably mountable to a main assembly of an apparatus and configured to supply a developer, said supply container including an accommodating portion configured to accommodate the developer, a discharge opening configured to discharge the developer out of said accommodating portion, and an expansion-and-contraction portion having a variable inside volume, wherein the developer is supplied from said supply container through said discharge opening using an inside pressure variation of said supply container caused by expansion and contraction of said expansion-and-contraction portion;

a receiving portion configured to receive the developer supplied from said supply container and to form a feeding path along which the developer is fed; and a decomposing member non-rotatably fixed at a position opposing, in a vertical direction, said discharge opening in said receiving portion and configured to collide with falling developer through said discharge opening to decompose the developer.

2. An apparatus according to claim 1, wherein said decomposing member is provided with an inclined surface inclined relative to a horizontal surface at a position right below said discharge opening, and an inclination angle of said inclined surface relative to the horizontal surface is larger than an angle of rest of the developer to be supplied.

3. An apparatus according to claim 1, wherein said decomposing member is provided with a first inclined surface and a second inclined surface, and a ridge between said first and second inclined surfaces is disposed right below said discharge opening.

4. An apparatus according to claim 1, wherein said decomposing member has surfaces forming a polygonal pyramid or a conical surface.

5. An apparatus according to claim 1, wherein a projection area of said discharge opening in a perpendicular direction overlaps entirely with said decomposing member.

6. An apparatus according to claim 1, wherein a distance between said discharge opening and said decomposing member is not less than 20 mm.

* * * * *